United States Patent [19]

Wang et al.

[11] Patent Number: 4,786,468

[45] Date of Patent: Nov. 22, 1988

[54] CORROSION RESISTANT TANTALUM AND TUNGSTEN ALLOYS

[75] Inventors: Rong Wang, Bellevue; Martin D. Merz, Richland, both of Wash.

[73] Assignee: Battelle Memorial Institute, Richland, Wash.

[21] Appl. No.: 60,759

[22] Filed: Jun. 4, 1987

[51] Int. Cl.[4] ..... B32B 15/00

[52] U.S. Cl. ..... 420/427; 148/403; 420/430

[58] Field of Search ..... 420/427, 430; 148/403

[56] References Cited

U.S. PATENT DOCUMENTS 3,184,304 5/1965 Andes ..... 420/430
3,669,656 6/1972 Murphy et al. ..... 420/430
3,859,055 1/1975 Larsen ..... 420/430
3,904,383 9/1975 Murphy et al. ..... 420/430
3,988,118 10/1976 Grierson et al. ..... 420/430

*Primary Examiner*—Upendra Roy
*Attorney, Agent, or Firm*—Joseph J. Hauth; Robert Keith Sharp

[57] ABSTRACT

New alloys highly resistant to corrosion by concentrated acid and having excellent adhering properties when coated on stainless steel are formed of 60 to 90 atomic percent tantalum or tungsten, with the remainder being iron, chromium and nickel in the proportions found in stainless steel, e.g., 304L stainless steel. They may be formed in situ on the surface to be coated by sputter deposition, using a sputter target which is part tungsten or tantalum, and part stainless steel.

7 Claims, No Drawings

CORROSION RESISTANT TANTALUM AND TUNGSTEN ALLOYS

INTRODUCTION

Reaction vessels, pipes leading to them, and similar apparatus are sometimes exposed to highly corrosive acids such as concentrated nitric acid. Stainless steels are commonly used for the construction of such equipment, but even they do not have sufficient corrosion resistance under certain circumstances. This is particularly true at weld points. The weld material appears to have less resistance to corrosion by nitric acid than the vessels or pipes as a whole. This invention deals with alloys of tantalum and tungsten with the constituents of stainless steel, which are highly resistant to corrosion even by hot 8N nitric acid. These alloys can be deposited on the stainless steel, particularly at the welds, and afford enhanced protection.

SUMMARY

The alloys of this invention contain from 60 to 90 percent tantalum or tungsten with the remainder being iron, chromium, and nickel in the proportions found in, e.g., 304L, stainless steel. They are highly resistant to corrosion by concentrated nitric acid and have excellent adhering properties when coated on stainless steel. They can be formed in situ on the surfaces to be coated by sputter deposition using a sputter target which is part tungsten or tantalum and part stainless steel, for example, of the type which is to be coated. The coatings can also be deposited on metals of other compositions, e.g., copper or carbon steel.

Typical alloys of this group expressed in atomic percent are as follows:

A. Tantalum 60 percent, chromium 8 percent, nickel 4 percent, iron 28 percent.
B. Tantalum 80 percent, chromium 4 percent, nickel 2 percent, iron 14 percent.
C. Tantalum 83 percent, chromium 3.4 percent, nickel 1.7 percent, iron 12 percent.
D. Tungsten 60 percent, chromium 8 percent, nickel 4 percent, iron 28 percent.
E. Tungsten 70 percent, chromium 6 percent, nickel 3 percent, iron 21 percent.
F. Tungsten 85 percent, chromium 3 percent, nickel 2 percent, iron 10 percent.

EXPERIMENTAL EXAMPLES

The following experiments demonstrate the preparation and properties of the alloys of our invention:

EXAMPLE I

A sputter target was fabricated by embedding eight ¼ inch diameter rods of tungsten of varying length in slots that were 3/16 inch deep in a three-inch diameter 304L stainless steel disc that was ½ inch thick. The aggregate areal fraction of tungsten was 78% of the total target area. The spacing between tungsten rods was ⅓ inch. The target was bolted and sealed so that it could be directly water-cooled on the backside, whic was external to the vacuum side of the sputtering chamber. The sputtering chamber was helium leak tested and the system pressure before filling with the sputtering gas was $2.7\times10^{-7}$ torr ($3.6\times10^{-5}$ Pa). High purity krypton sputtering gas was admitted to the chamber and maintained at an indicated pressure of 3 to 4 millitorr (0.4 to 0.6 Pa) during the deposition run. A polished copper substrate was used as the deposition surface. The substrate surface in the sputtering chamber was ion etched to promote adherence of the material and to prevent peeling. The substrate and target were water cooled during the run and were maintained at 14° C. The plasma was generated using a filament current of 58 A, a plasma potential of −34 VDC and plasma current of 27 A. A 10 mil thick deposit was produced in 6.5 hours at a target voltage of −500 VDC and a target current of 400 mA, which corresponded to a target current density of 8.8 mA/cm$^2$. The as-deposited material had a composition of $Fe_{10}Cr_3Ni_2W_{85}$ and was primarily microcrystalline, as indicated by X-ray diffraction. Corrosion samples were cut by slicing the deposit and copper substrate and then removing the copper with concentrated nitric acid. The corrosion rate of the free-standing deposited alloy was measured subsequently by weight loss measurement caused by 1 week immersion in 8 Normal $HNO_3$ at 100° C. The weight loss per unit area was 0.02 mg/cm$^2$, which corresponded to a corrosion rate of less than 0.001 mm/year. The material had a very adherent, slightly green corrosion film. The corrosion rate of AISI 304L stainless steel under these conditions is approximately 0.05 mm:/year.

EXAMPLE II

An additional sample with the composition $Fe_{21}Cr_6Ni_3W_{70}$ was prepared using methods similar to that described in Example I, except the target areal fraction of tungsten was reduced to 51% to obtain a lower amount of tungsten in the deposited material. The deposited material was microcrystalline, as indicated by X-ray diffraction. Corrosion samples were prepared as described in Example I and the corrosion rate of the alloy was less than 0.002 mm/year in 8 Normal $HNO_3$ at 100° C. This material had a very adherent, slightly green corrosion film after testing.

EXAMPLE III

An additional sample of $Fe_{13}Cr_3Ni_1Ta_{83}$ was prepared using the techniques described in Example I except tantalum rods were placed in the 304L stainless steel disc sputtering target. The areal fraction of tantalum was 78%. The deposited material was amorphous as measured by X-ray diffraction. The deposited material was removed from the copper substrate as described in Example I for corrosion rate measurement. The corrosion rate in 8 Normal $HNO_3$ was less than 0.002 mm:/year at 100° C, based on a weight loss per unit area of 0.05 mg/cm$^2$ or less for 1 week exposure to 8 Normal $HNO_3$ at 100° C. The material remained unchanged in appearance during the exposure to the acid.

EXAMPLE IV

A refractory amorphous metal alloy coating was prepared on a copper substrate by high rate sputter deposition using a 304L stainless steel target containing several Ta-rod inserts. The deposited coating had an amorphous structure and a composition of 60 atom percent Ta balanced by the 304L stainless steel composition. The coating was about 100 micrometers thick. Corrosion rate was determined by immersion of the coating materials in 8 N nitric acid boiling at 110° C. for 7 days. After the corrosion test, the coating material retained its metallic luster on the surface and no corrosion marks were visible. The coatings after corrosion test had a small weight gain ranging from 0.015 to 0.020 percent of the initial weight of the coating materials. The corrosion rate in this case was estimated as below 0.01 n/year. A similar alloy of 58 percent Ta balance iron, chromium, and nickel in the proportions of 304L stainless steel, prepared in the same way but deposited on 304L stainless steel showed very good adherence to the sheet and had corrosion rates in the range of 0.010 to 0.016 mm/yr in 8N $HNO_3$.

It will be seen that the higher proportions of tungsten and tantalum produce superior general corrosion resistance as compared to the 60 percent alloy of Example IV and that all were much better than the stainless steel. While the tests showed somewhat general corrosion better resistance by the microcrystalline tungsten alloys than by the amorphous tantalum alloy, the latter is considered to be preferable in practical use since the amorphous metal would have less tendency toward pitting than the microcrystalline material.

The embodiments of the invention in which a proprietary right or privilege are claimed are defined as follows:

1. A corrosion resistant alloy consisting essentially of tantalum or tungsten in the range of 60 to 90 atomic percent, balance iron, chromium, and nickel, said iron, chromium, and nickel being present in the relative proportions present in a stainless steel.

2. An alloy as defined in claim 1 wherein the stainless steel is of the 300 series.

3. An alloy as defined in claim 1 wherein the stainless steel is 304L stainless steel.

4. An alloy as defined in claim 1 consisting essentially of 83 atomic percent tantalum, 13 atomic percent iron, 3 atomic percent chromium and 1 atomic percent nickel.

5. An alloy as defined in claim 1 consisting essentially of 70 atomic percent tungsten, 21 atomic percent iron, 6 atomic percent chromium and 3 atomic percent nickel, said alloy being microcrystalline.

6. An alloy as defined in claim 1 consisting essentially of 85 atomic percent tungsten., 10 atomic percent iron 3 atomic percent chromium, and 2 atomic percent nickel, said alloy being microcrystalline.

7. An alloy as defined in claim 3 wherein said alloy is amorphous.

* * * * *